US006298546B1

(12) United States Patent
Slota

(10) Patent No.: US 6,298,546 B1
(45) Date of Patent: Oct. 9, 2001

(54) DEVICE AND METHOD TO QUANTITATIVELY POSITION A GOLF CLUB HANDLE GRIP

(76) Inventor: John Emil Slota, 310 Clarewood Cir., Grayslake, IL (US) 60030

( * ) Notice: Subject to any disclaimer, the term of this patent is extended or adjusted under 35 U.S.C. 154(b) by 0 days.

(21) Appl. No.: 09/374,166

(22) Filed: Aug. 13, 1999

(51) Int. Cl.[7] ..... B23D 21/00

(52) U.S. Cl. ..... 29/720; 473/206; 473/239; 33/508; 33/1 N; 33/534

(58) Field of Search ..... 29/720; 473/206, 473/239, 131; 33/508, 1 N, 534

(56) References Cited

U.S. PATENT DOCUMENTS 4,655,457 * 4/1987 Thompson ..... 273/162 R
4,858,332 * 8/1989 Thomas ..... 33/508
5,125,655 * 6/1992 Crooks ..... 273/32 H

* cited by examiner

*Primary Examiner*—S. Thomas Hughes
*Assistant Examiner*—John C. Hong

(57) ABSTRACT

A device and method to position a newly installed grip or to verify the position of one previously installed, quantitatively, in relation to the leading edge of a golf club head or any point referenced by the alignment assembly. The invention includes two components. The first component is an alignment assembly, removably attachable to the shaft for identifying the position of the shaft diameter that is substantially parallel to the leading edge of the golf club head. The alignment assembly is comprised of an alignment rod and removable pointer both mounted on a support providing a substantially planar surface. The second component is a shaft rotation gauge, removably attachable to the shaft for measuring the deviation of any point on a grip or shaft from any position referenced by the alignment assembly. The shaft rotation gauge is comprised of an arched ruled indicator surface attached to and radially extended a predetermined distance from the shaft axis.

13 Claims, 3 Drawing Sheets

DEVICE AND METHOD TO QUANTITATIVELY POSITION A GOLF CLUB HANDLE GRIP

CROSS-REFERENCE TO RELATED APPLICATIONS (Not Applicable)

STATEMENT REGARDING FEDERALLY SPONSORED RESEARCH OR DEVELOPMENT (Not Applicable)

REFERENCE TO A MICROFICHE APPENDIX (Not Applicable)

BACKGROUND OF THE INVENTION

1. Field of the Invention

This invention relates generally to golf clubs and more specifically to a device and method to quantitatively position a golf club handle grip.

2. Description of Relevant Art

Correctly aligning the golf club leading edge in relation to an intended target is a hallmark of golf instruction. Precise placement of the hands on a golf club handle grip is an important extension of the alignment principle. Hand placement on a golf club handle grip can assume many positions in relation to the clubhead. Further, those skilled in the game teach that deviations in hand placement, intentional or not, can influence a golf ball's flight. In fact, many grips have indicia and raised areas called reminder ribs intended for use as alignment aids to facilitate placement of the hands correctly in relation to the clubhead.

Golf club handle grips wear or individual preferences change, consequently, grip replacement occurs several times during the life of a set of golf clubs. Installation of common rubber composite grips generally involves removing the old grip and grip tape and applying double sided adhesive tape to the club handle. Next the tape is activated by wetting with solvent and the new grip is slipped on the handle. The appropriate grip indicia are then positioned in relation to the clubhead's leading (striking) edge so both form lines that are simultaneously substantially perpendicular to an intended target.

Grip installation protocols disclosed by Karner (U.S. Pat. No. 5,870,304), Hsu (U.S. Pat. No. 4,899,428) and Gore (U.S. Pat. No. 4,869,304) include aligning and restraining or clamping the club in the aligned position and finally, installing the grip. All the above disclosed methods for installing grips accomplish the alignment task by using large, relatively complex apparatus. Crooks (U.S. Pat. No. 5,125,655) disclosed an alignment device with a marking template but this system is limited in application. Most wood clubs have their hosels and shafts offset from the face portion of the clubhead. This property of golf clubs will restrict accurate positioning of the device claimed by Crooks.

The ability to verify grip installation and quantify and mark preferred positions on a handle grip are beneficial to the golfer. The apparatus of Karner (U.S. Pat. No. 5,870,304), Hsu (U.S. Pat. No. 4,899,428), Gore (U.S. Pat. No. 4,869,304) and Crooks (U.S. Pat. No. 5,125,655) partially satisfy these desirable attributes, but none provide means to quantify preferred positions on a grip. None of the referenced apparatus measure the deviation of any point on a handle grip from an aligned clubhead position. The present invention provides a device and method that fulfill all the attributes mentioned while being suited for use by a larger cross-section of independent clubmakers and golfers who occasionally replace golf club handle grips.

BRIEF SUMMARY OF THE INVENTION

The present invention includes two components, the first is the alignment assembly removably attachable to the shaft for identifying the diameter of a shaft cross section that is both substantially perpendicular to the shaft axis and substantially parallel to the clubhead leading edge. The alignment assembly includes an alignment rod and removable pointer mounted on a support providing a substantially planar surface. The second is a shaft rotation gauge removably attachable to the shaft for measuring the deviation of any point on a grip or shaft from any position referenced by the alignment assembly. The shaft rotation gauge includes an arched ruled indicator surface attached to and radially extended a predetermined distance from the shaft axis. The present invention overcomes problems of previous apparatus and methods by providing a simple accurate device and method to position a newly installed grip or to verify the position of a previously installed grip quantitatively, in relation to the leading edge of a golf club head.

Accordingly, several objects and advantages of the present invention are:

(a) to provide an alignment device and method generally applicable for use with iron and wood style golf clubs.

(b) to provide an alignment device and method which also eliminates the need to clamp the clubhead for grip alignment.

(c) to provide a device and method which allow the club handle to freely rotate 360 degrees about the alignment device allowing the operator to set other indicia substantially parallel to those which indicate face alignment.

(d) to provide a device and method which correctly position a grip in relation to the leading edge of the clubhead.

(e) to provide a device alignment rod which also can be used as a template for marking preferred positions on a grip.

(f) to provide a device alignment rod which further can be used to reference grip length and therefore, verify correct grip thickness.

(g) to provide a device shaft rotation gauge removably attachable to the shaft for measuring the deviation of any point on a grip or shaft from any position referenced by the device alignment assembly and pointer.

(h) to provide a device shaft rotation gauge removably attachable to the shaft which further can measure the offset of an iron style golf club.

(i) to provide an alignment device and method generally applicable for use with left or right handed golf clubs.

(j) to provide a device which can also be used to assist positioning shaft indicia of iron type golf clubs.

Further objects and advantages will become apparent from a consideration of the accompianing drawings and detailed description.

DETAILED DESCRIPTION OF THE INVENTION

Figure 1:
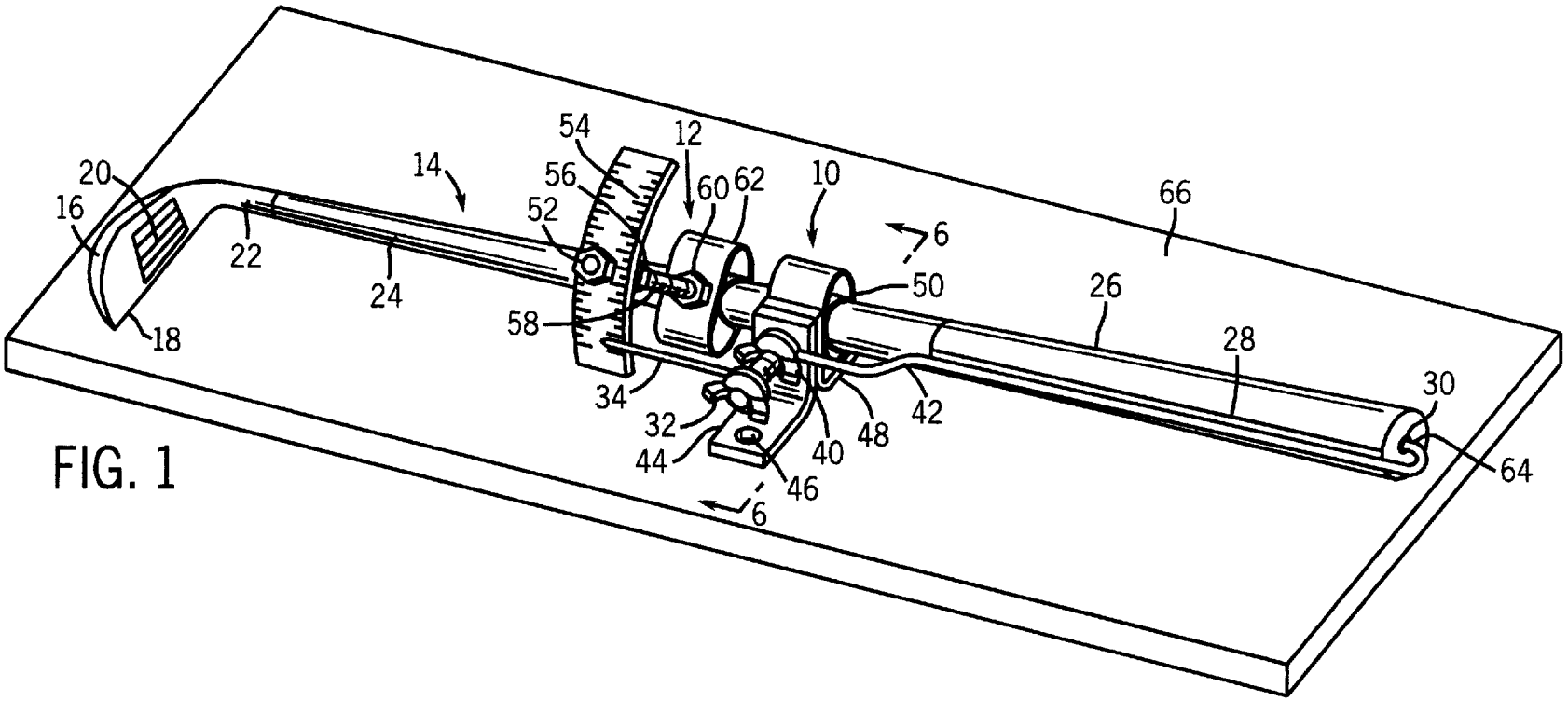
FIG. 1 is a perspective view of the alignment assembly and shaft rotation gauge.

Referring in detail to the drawings, FIG. 1 shows the alignment assembly 10 and shaft rotation gauge 12 attached removably to the shaft 24 of a conventional iron type golf club 14. The golf club 14 includes a clubhead 16 mounted on the tip end of the shaft 24 and a handle grip 26 with alignment indicia 28 mounted on the handle end of the shaft 24. The clubhead 16 includes a leading or striking edge 18 in contact with a substantially planar surface 66, grooves known as score lines 20 substantially parallel to the leading edge 18 and a hosel 22 through which the clubhead 16 connects to the shaft 24. The handle grip center hole 30 is located at the butt end of the shaft 24. The alignment rod 42 is shown with its tip end 64 inserted in the handle grip center hole 30. The alignment rod 42 and pointer 34 are removably attachable to the alignment assembly 10 by wing nuts 40 and 32 or other securement means allowing adjustable tightness without requiring tools. Corner braces 44 and 48 are joined to form the alignment assembly 10 support base which is substantially parallel to and rests on the substantially planar surface 66.

Figure 2:
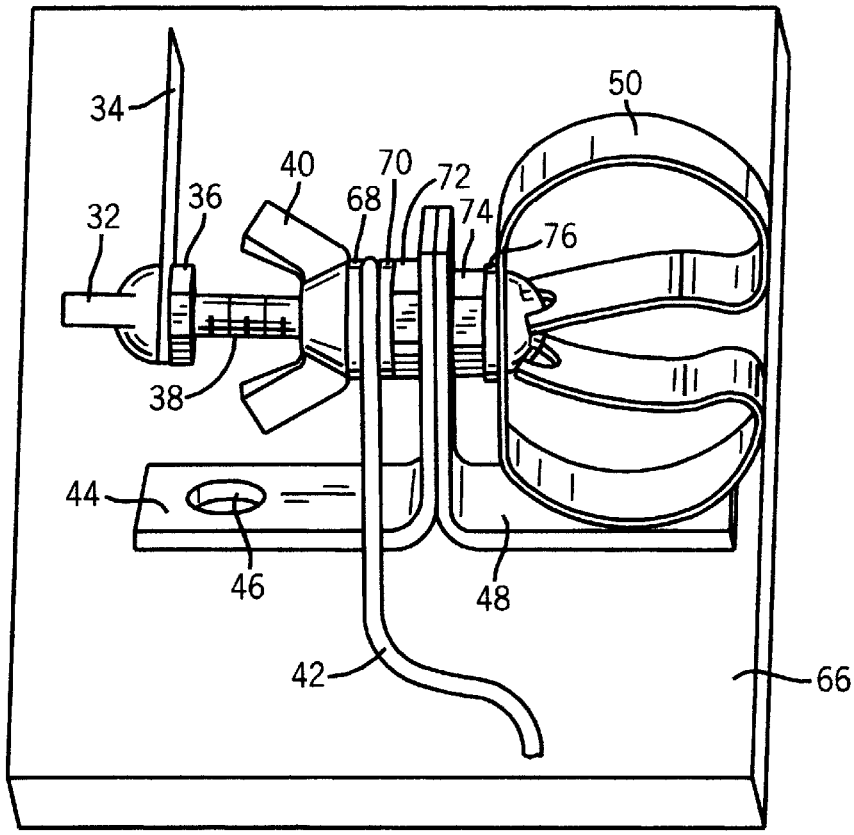
FIG. 2 is an enlarged view of the alignment assembly in perspective partially broken away prior to being releasably attached to the golf club shaft.

A tension clip 62 attaches the shaft rotation gauge 12 removably to the shaft 24 below the alignment assembly 10 so the pointer 34 is just above the indicia on one side of the arched ruled indicator surface 54. Details of a preferred alignment assembly 10 are shown in FIG. 2. A stove bolt 38 or other suitable mounting and retention means passes through an aperture in the tension clip 50, apertures in corner braces 44 and 48 and loop ends in the alignment rod 42 and pointer 34. The tension clip 50 and washer 76 are installed to move freely about the stove bolt 38 axis without unnecessary wobble. Corner braces 44 and 48 are joined using hex nuts 72 and 74 or other suitable securement means such that the substantially vertical segments are superimposed and the substantially horizontal segments form a support base substantially parallel to the substantially planar surface 66. Corner braces 44 and 48 also have apertures 46 on the substantially horizontal segments to optionally make the alignment assembly 10 removably attachable to the substantially planar surface 66. Washers 68 and 70 installed on the stove bolt 38 on either side of the the alignment rod 42 provide substantially flat surfaces against the loop end of the alignment rod 42. The alignment rod is adjustably secured by means of a wing nut 40. A hex nut 36 or other adjustable securement means limits the distance the pointer 34 can travel down the stove bolt 38. The distance of the pointer 34 from the shaft 24 is slightly greater than that of the arched ruled indicator surface 54 shown in FIG. 1. The pointer 34 can be a specifically machined part or merely can be metal with approximately 1½ inch×1 mm thick tapering to a point of less than approximately 0.25 mm with a loop fashioned at the end opposite the point.

Figure 3:
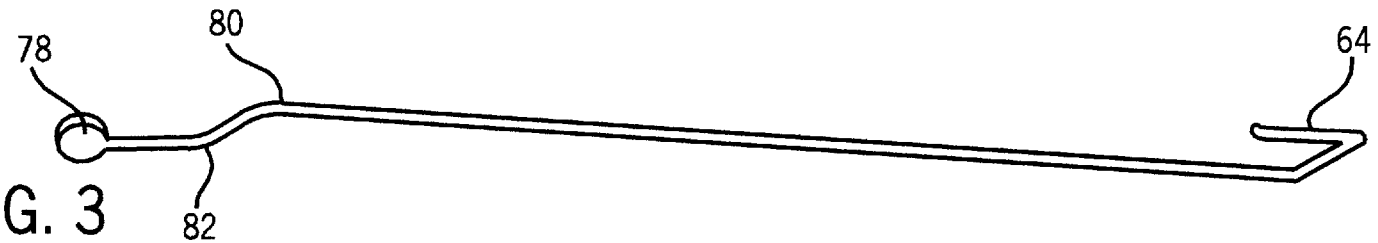
FIG. 3 is a front elevational view of the alignment rod prior to being releasably attached to the alignment assembly.

FIG. 3 is an enlarged view of the alignment rod 42 which illustrates in detail the loop end 78, angle bends 80 and 82 and the tip end 64. In the preferred embodiment, the alignment rod 42 is a rigid, malleable, ductile material such as brass, piano wire steel or an alloy of various types of metals. However, materials such as plastic, capable of being molded into the prescribed shape are also acceptable. The angle bend 82 is approximately 90 degrees and designed to bring the alignment rod 42 quickly toward the shaft 24. The angle bend 80 is approximately 5 degrees and designed to move the alignment rod 42 gradually away from the shaft 24 as it approaches the butt end of the shaft. All points on the alignment rod from the tip end 64 up to and including two points on the loop end 78 lie substantially in the same plane. The plane formed is substantially perpendicular to the loop end 78 and intersects substantially at its center.

Figure 4:
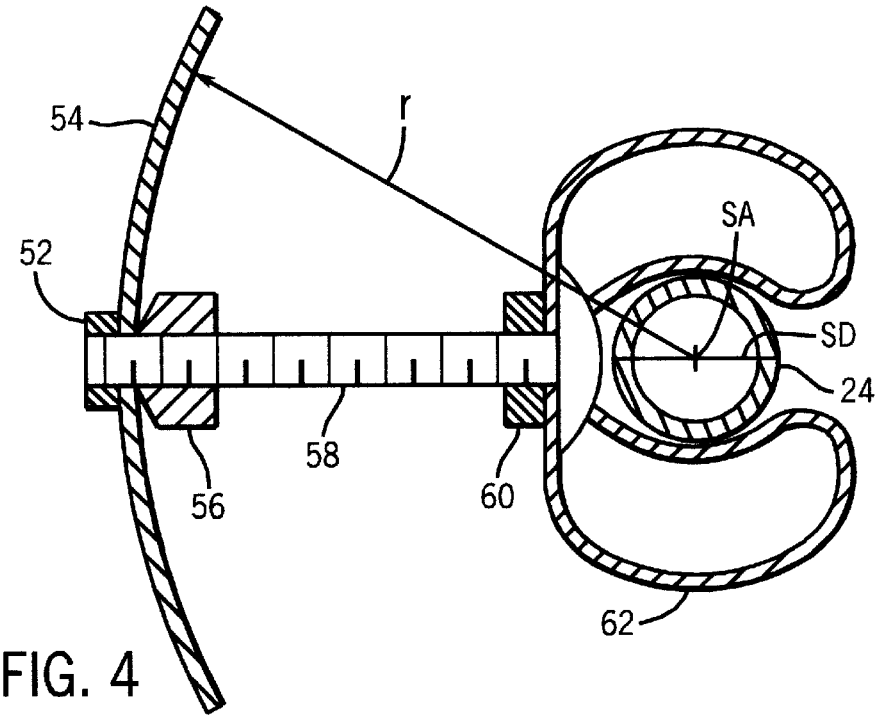
FIG. 4 is an enlarged cross sectional view of the shaft rotation gauge with radius r.

FIG. 4 is a cross sectional view of the shaft rotation gauge 12 with radius r. The tension clip 62 is attached removably to the shaft 24 establishing the radius r. The stove bolt 58 passes through an aperture in the tension clip 62 and is secured by means of a hex nut 60 or other means of securement. In the preferred embodiment, a stop nut 56 limits the movement of the arched ruled indicator surface 54 of the shaft rotation gauge 12. A hex nut 52 secures the arched ruled indicator surface 54 to the stove bolt 58.

Figure 5:
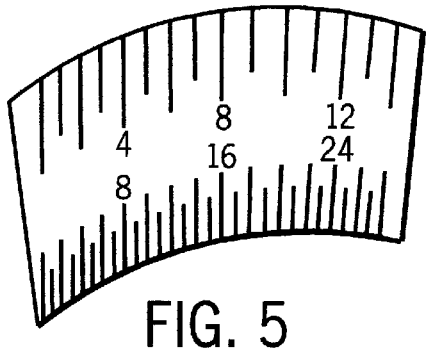
FIG. 5 is an enlarged view of the arched ruled indicator surface partially broken away.

FIG. 5 is an enlarged view of the arched ruled indicator surface 54 of the shaft rotation gauge 12. Many materials will produce the same effect, however, in the preferred embodiment, the arched ruled indicator surface 54 is a steel rule with 1/36 inch and 1/64 inch scales. The ruled surface is curved to substantially match the circumference of a circle with radius r shown in FIG. 4.

In use, referring to FIGS. 1 and 2 for right hand style clubs, the golf club 14 is placed on a substantially planar surface 66 so the leading edge 18 is nearer the operator than the hosel 22. The alignment assembly 10 is placed on the substantially planar surface 66 between the operator and the club shaft 24 with the tension clip 50 nearest the shaft 24. The alignment assembly wing nut 40 is loosened so that the alignment rod 42 moves freely. The tip end of the alignment rod 64 is inserted into the center hole 30 of the handle grip 26 and placing thumbs on the alignment assembly 10 and fingers on the club shaft 24, the operator gently squeezes to engage the tension clip 50 to the shaft 24. Next the wing nut 40 is finger tightened. The tension clip 62 of the shaft rotation gauge 12 is attached removably to the shaft 24 approximately one inch closer to the clubhead 16 than the alignment assembly 10. Using the wing nut 32 and hex nut 36, or suitable adjustment means, the pointer 34 is positioned approximately parallel to the club shaft 24 so that its tapered tip end is just above one set of indicia on the arched ruled indicator surface 54. The operator uses one hand to hold the alignment assembly 10 against the substantially planar surface 66 and the other to rotate the golf club 14 until its leading edge 18 and score lines 20 are substantially parallel to the substantially planar surface 66. In an alternate embodiment an optional cylindrical spirit level approximately one inch long by three-eighths inch in diameter is fixed on the clubface substantially parallel to the score lines 20 using double sided tape to facilitate this step. The operator lifts the golf club 14 to a substantially vertical position and facing the alignment rod 42 correctly positions indicia 28 on a newly installed handle grip 26 or using the alignment rod as a template, marks the aligned position on an existing handle grip 26. Using only the alignment assembly 10 the operator can accomplish the above tasks, however to measure the deviation of any point on the handle grip 26 from any position referenced by the alignment assembly 10, the shaft rotation gauge 12 is used. The operator notes the value on the shaft rotation gauge 12 referenced by the pointer 34 and rotates the alignment assembly 10 clockwise or counterclockwise the desired distance. The pointer 34 indicates the number of inches of arc and therefore, degrees the alignment rod 42 has rotated from its initial position. If the operator begins with the clubhead leading edge 18 in the aligned position and holds the alignment assembly 10 against a substantially planar surface 66, then the number of degrees rotation of the shaft rotation gauge 12 is equal to the number of degrees the clubhead leading edge 18 is open or closed to the aligned position. In the preferred embodiment, inches of arc measured by the arched ruled indicator surface 54 is converted to degrees rotation by a mathematical relationship. In an alternate embodiment degrees rotation can be the unit of measure on the arched ruled indicator surface 54.

Clubhead offset for iron style golf clubs 14, or the separation between the leading edge 18 of the clubhead 16 and hosel 22 can be measured. Offset is the measured distance on the shaft rotation gauge 12 arched ruled indicator surface 54 from when the leading edge 18 of the clubhead 16 and hosel 22 are at rest on the substantially planar surface 66 to when the leading edge 18 of the clubhead 16 is substantially parallel to the substantially planar surface 66.

Figure 6:
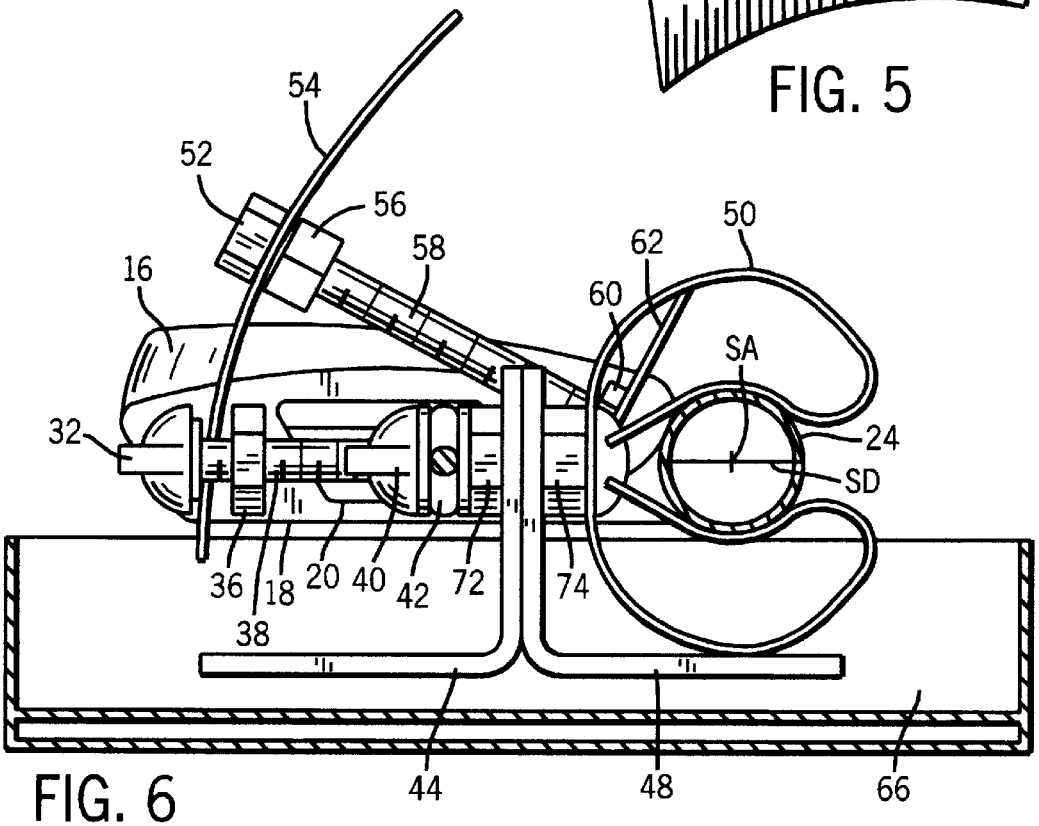
FIG. 6 is a front plan view taken along lines 6—6 of FIG. 1, showing the clubhead leading edge substantially parallel to the reference plane.

As shown in FIG. 6, in the aligned position, the alignment assembly corner braces 44 and 48 rest on the substantially planar surface 66. The stove bolt 38, scorelines 20 and leading edge 18 of the clubhead 16 are substantially parallel to the substantially planar surface 66. The stove bolt 38 indicates the position of the diameter SD of a shaft 24 cross-section that is substantially perpendicular to the shaft axis SA. The stove bolt 38 and shaft diameter SD are both substantially parallel to the leading edge 18 of the clubhead 16. The alignment rod 42 indicates the position of all such diameters from the position referenced by the stove bolt 38 to the butt end of the handle grip 26.

Figure 7:
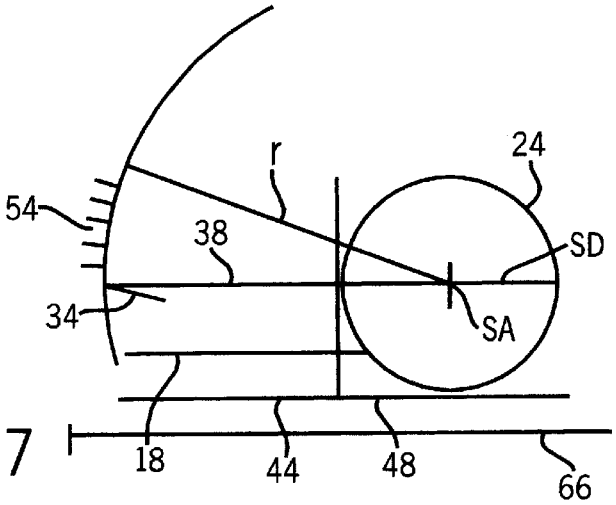
FIG. 7 is a diagrammatic view of the aligned position of FIG. 6.

The aligned position is illustrated schematically in FIG. 7. Corner braces 44 and 48 are at rest on the substantially planar surface 66. The stove bolt 38 indicates the position of the diameter SD of a shaft 24 cross-section that is substantially perpendicular to the shaft axis SA. The stove bolt 38 and shaft diameter SD are both substantially parallel to the leading edge 18 of the clubhead 16. The pointer 34 indicates the aligned position on the arched ruled indicator surface 54. The arched ruled indicator surface 54 describes a circle with radius r a predetermined distance from the shaft axis SA. Degrees rotation from the aligned position is mathematically related to the distance travelled along the arched ruled indicator surface 54.

Although the present invention has been described with respect to specific embodiments, those skilled in the art will understand that variations may be made within the scope of the appended claims.

I claim:

1. A device to quantitatively position a golf club handle grip, said device comprising:

an alignment assembly having:

a first fastening means removably attachable to a golf club shaft to establish a golf clubshaft cross-section substantially perpendicular to the axis of said shaft said first fastening means including a first receiving region indicating a first diameter of said golf club shaft cross-section;

a planar base with substantially vertical face member;

said substantially vertical face member including a second receiving region;

a first mounting and retention means attached substantially perpendicular to said first and said second receiving regions further, indicating said first diameter;

alignment means hingedly connected substantially perpendicular to the axis of said first mounting and retention means;

pointer means hingedly connected substantially perpendicular to the axis of said first mounting and retention means;

a shaft rotation gauge having:

a second fastening means removably attachable to a golf club shaft to establish a golf club shaft cross-section substantially perpendicular to the axis of said shaft;

said second fastening means including a third receiving region indicating a second diameter of said golf club shaft cross-section;

a second mounting and retention means attached substantially perpendicular to said third receiving region further indicating said second diameter;

a ruled surface attached substantially perpendicular to the axis of said second mounting and retention means;

said ruled surface a measured radius from said shaft axis further having an arc substantially correct in relation to a circle with said radius and said ruled surface in communication with said pointer means, wherein the distal end of said alignment means inserts into the grip center hole.

2. The device of claim 1, wherein said first or second fastening means is a tension clip.

3. The device of claim 1, wherein said first receiving region is an aperture.

4. The device of claim 1, wherein said second receiving region is an aperture.

5. The device of claim 1, wherein said third receiving region is an aperture.

6. The device of claim 1, wherein said planar base with said vertical face member is comprised of two corner braces.

7. The device of claim 1, wherein said first mounting and retention means is a threaded bolt.

8. The device of claim 1, wherein said second mounting and retention means is a threaded bolt.

9. The device of claim 1, wherein said second fastening means is a hex nut.

10. The device of claim 1, wherein said alignment means is removably attachable to the axis of said first mounting and retention means.

11. The device of claim 1, wherein said pointer means is removably attached to the axis of said first mounting and retention means by a wing nut.

12. The device of claim 1, wherein said alignment means is removably attached to the axis of said first mounting and retention means by a wing nut.

13. The device of claim 1, wherein said alignment rod is slightly greater in length than said golf club handle grip.

* * * * *